US009964347B2

(12) United States Patent
Kim et al.

(10) Patent No.: US 9,964,347 B2
(45) Date of Patent: May 8, 2018

(54) APPARATUS FOR CONTROLLING AN AIR CONDITIONER

(71) Applicant: LG ELECTRONICS INC., Seoul (KR)

(72) Inventors: Seontaek Kim, Changwon-si (KR); Hana Park, Changwon-si (KR); Seongjin Shin, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 690 days.

(21) Appl. No.: 14/077,417

(22) Filed: Nov. 12, 2013

(65) Prior Publication Data

US 2014/0137583 A1 May 22, 2014

(30) Foreign Application Priority Data

Nov. 12, 2012 (KR) ..... 10-2012-0127472

(51) Int. Cl.
*F24F 11/00* (2018.01)
*F25B 49/00* (2006.01)

(52) U.S. Cl.
CPC ..... *F25B 49/00* (2013.01); *F24F 11/001* (2013.01); *F24F 11/0086* (2013.01);
(Continued)

(58) Field of Classification Search
CPC ..... F24F 2011/0091; F24F 11/0086; F24F 49/00; F24F 11/00; F24F 11/30; F24F 11/32; F24F 11/38; F24F 11/52
See application file for complete search history.

(56) References Cited

U.S. PATENT DOCUMENTS 5,602,758 A * 2/1997 Lincoln ..... F24F 11/006 165/205
6,122,603 A * 9/2000 Budike, Jr. ..... G01D 4/004 340/870.02

(Continued)

FOREIGN PATENT DOCUMENTS

CN 1786605 6/2006
CN 101403523 4/2009

(Continued)

OTHER PUBLICATIONS

European Search Report dated Jan. 30, 2014.

(Continued)

*Primary Examiner* — Ljiljana Ciric
*Assistant Examiner* — Alexis Cox
(74) *Attorney, Agent, or Firm* — KED & Associates, LLP

(57) ABSTRACT

A control apparatus may include an input, an output, a communication device, and a processor. The processor to control the plurality of component devices, and receive the cycle data from the plurality of component devices to enable problem diagnosis on the plurality of component devices, in real time. The processor to display, in a frame, the cycle data for the plurality of component devices, display the cycle data corresponding to actual connection states, installed positions, and present operation states of the plurality of component devices, and change the cycle data thus displayed when the cycle data for the plurality of component devices changes. The cycle data may include data information on whether each of the plurality of component devices is in operation or is not in operation and a cycle change.

25 Claims, 13 Drawing Sheets

(52) U.S. Cl.
CPC ..... *F24F 11/32* (2018.01); *F24F 11/52* (2018.01); *F24F 11/30* (2018.01); *F24F 11/38* (2018.01); *F24F 2011/0052* (2013.01)

(56) References Cited

U.S. PATENT DOCUMENTS

| | | | | |
|---|---|---|---|---|
| 7,823,397 | B2 * | 11/2010 | Chang | F24F 1/26 137/557 |
| 8,788,104 | B2 | 7/2014 | Kowald et al. | |
| 9,625,893 | B2 * | 4/2017 | Cho | G05B 19/02 |
| 2002/0011923 | A1 | 1/2002 | Cunningham et al. | |
| 2002/0029096 | A1 | 3/2002 | Takai et al. | |
| 2003/0140637 | A1 * | 7/2003 | Masui | F24F 11/006 62/127 |
| 2003/0216839 | A1 * | 11/2003 | Dudley | F24F 11/0086 700/277 |
| 2004/0238653 | A1 * | 12/2004 | Alles | F24F 3/0442 236/49.3 |
| 2004/0249597 | A1 * | 12/2004 | Whitehead | F24F 11/006 702/118 |
| 2005/0040248 | A1 * | 2/2005 | Wacker | F24F 11/0086 236/51 |
| 2005/0097905 | A1 | 5/2005 | Kwon et al. | |
| 2005/0103874 | A1 * | 5/2005 | Erdman, Jr. | F24F 11/0086 236/51 |
| 2005/0109048 | A1 | 5/2005 | Lee | |
| 2005/0229610 | A1 | 10/2005 | Park et al. | |
| 2006/0247904 | A1 * | 11/2006 | Dariush | B25J 9/0006 703/11 |
| 2007/0039376 | A1 * | 2/2007 | Son | F24F 11/0086 73/31.01 |
| 2007/0252633 | A1 * | 11/2007 | Frankel | G01D 1/10 327/335 |
| 2009/0027334 | A1 | 1/2009 | Foulk et al. | |
| 2009/0057424 | A1 | 3/2009 | Sullivan et al. | |
| 2010/0286937 | A1 | 11/2010 | Hedley et al. | |
| 2011/0046792 | A1 * | 2/2011 | Imes | F24F 11/0086 700/278 |
| 2011/0202185 | A1 * | 8/2011 | Imes | H04L 43/08 700/277 |
| 2011/0298301 | A1 * | 12/2011 | Wong | H04L 12/2827 307/116 |
| 2012/0251963 | A1 * | 10/2012 | Barker | F23N 5/003 432/1 |
| 2012/0271576 | A1 * | 10/2012 | Kamel | H02J 13/0006 702/62 |
| 2013/0211783 | A1 * | 8/2013 | Fisher | G06F 11/30 702/182 |
| 2014/0130524 | A1 * | 5/2014 | Kim | F25B 49/00 62/56 |
| 2014/0137584 | A1 * | 5/2014 | Kim | F25B 49/00 62/126 |

FOREIGN PATENT DOCUMENTS

| | | | |
|---|---|---|---|
| CN | 101424426 | | 5/2009 |
| EP | 2 306 104 | | 4/2011 |
| JP | H08-210694 | A | 8/1996 |
| JP | 2004003831 | A * | 1/2004 |
| KR | 10-2006-0064822 | A | 6/2006 |
| KR | 10-0680218 | B1 | 2/2007 |
| KR | 10-2007-0108648 | | 11/2007 |
| KR | 10-2008-0050696 | | 6/2008 |
| KR | 10-2008-0059909 | A | 7/2008 |
| KR | 10-2009-0041604 | | 4/2009 |
| KR | 10-2010-0123487 | A | 11/2010 |

OTHER PUBLICATIONS

U.S. Notice of Allowance dated Apr. 11, 2016 issued in U.S. Appl. No. 14/077,423.

U.S. Office Action dated Aug. 10, 2016 issued in U.S. Appl. No. 14/077,428.

United States Office Action dated Mar. 23, 2017 issued in co-pending U.S. Appl. No. 14/077,428.

* cited by examiner

APPARATUS FOR CONTROLLING AN AIR CONDITIONER

CROSS-REFERENCE TO RELATED APPLICATION(S)

This application claims priority to Korean Patent Application No. 10-2012-0127472, filed on Nov. 12, 2012 in the Korean Intellectual Property Office, the disclosure of which is incorporated herein by reference.

BACKGROUND

1. Field

An apparatus for controlling an air conditioner is disclosed herein.

2. Background

Apparatuses for controlling air conditioners are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

The advantages, features, and methods for achieving those will become apparent upon referring to embodiments described later in detail together with the attached drawings. However, embodiments are not limited by those disclosed hereinafter, but may be embodied in different modes. The embodiments are provided for making a disclosure and notifying a scope to persons skilled in this field of art completely, and embodiments will be defined only by scope of claims. Wherever possible, the same reference numbers will be used throughout the drawings to refer to the same or like parts.

An apparatus for controlling an air conditioner in accordance with an embodiment will be described in detail with reference to the attached drawings.

In general, a control apparatus controls a domestic appliance, such as a TV, a video device, an audio device, an air conditioner, a cable broadcasting converter, a satellite broadcasting converter, or a fan. Depending on the application, the control apparatus may remotely control various domestic appliances by wireless transmission of a control frequency or cable communication. The control apparatus may be a specialized apparatus to a particular domestic appliance, or a computer having software loaded thereon to control a particular domestic appliance.

Such a control apparatus may be applied to an air conditioner. A multi-type air conditioner used in a large-sized building, which requires a plurality of indoor units or devices, may have one outdoor unit or device connected to the plurality of indoor devices. As the plurality of indoor devices may be installed in respective rooms to air condition the rooms, an effect may be obtained that a plurality of air conditioners are installed in the building.

In general, the multi-type air conditioner is provided with a central controller to control and monitor a state of the air conditioner in a position of a user, to enable the use to monitor temperature, an operation mode, and whether the air conditioner has something wrong with it or not. However, if the air conditioner has something wrong with it, a state of the air conditioner needs to be inspected based, not on simple state data, but rather, on various data for each unit or device of the air conditioner, for proper inspection.

Though an apparatus that accesses and inspects one of the units or devices of the air conditioner, to carry out a proper inspection of the state, shows data on each of the devices one by one, because an amount of the data is massive, there has been a problem in that it is difficult to forward the data effectively and to easily grasp a state of the data. Moreover, it is difficult to determine a cycle state of the air conditioner with only a simple list of the data, and a scheme is required to easily determine the cycle state.

Figure 1:
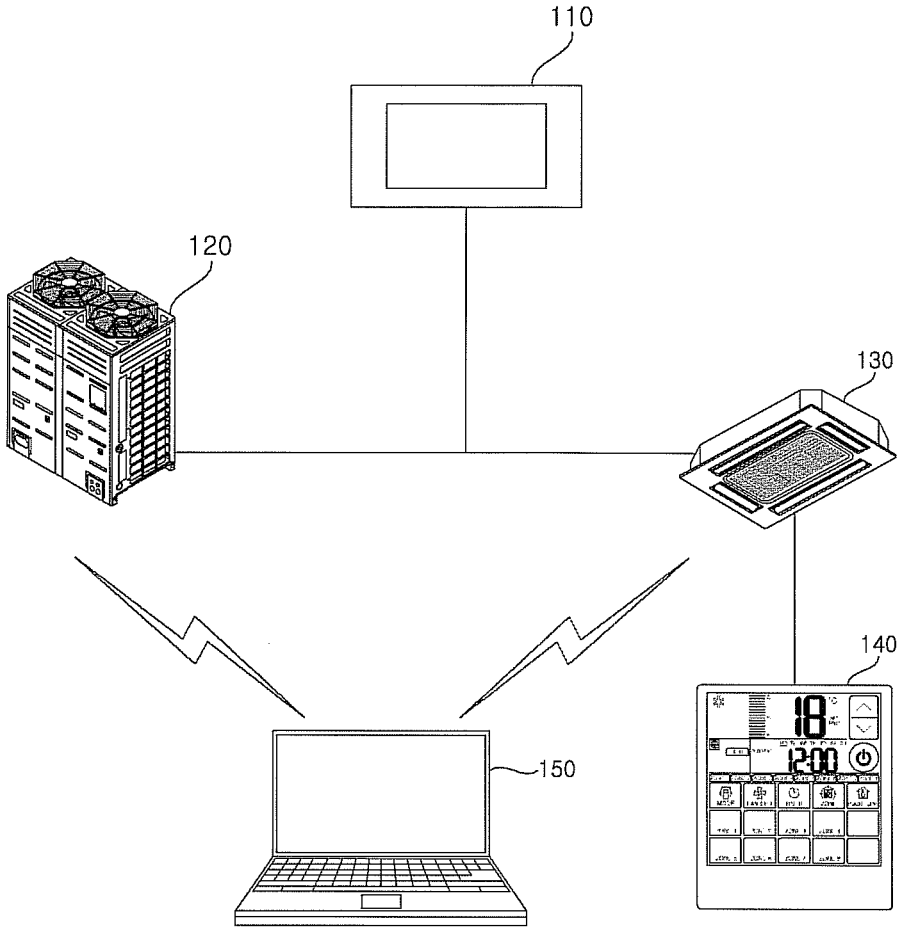
FIGS. 1 to 3 are schematic diagrams of an air conditioner system including a control apparatus in accordance with embodiments.
Figure 2A:
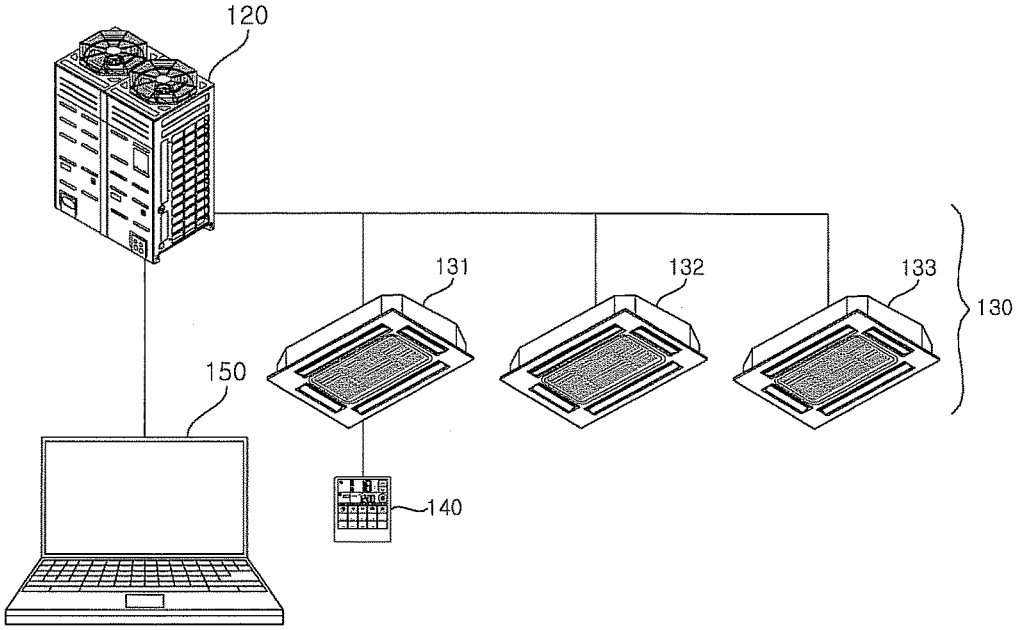
Figure 2B:
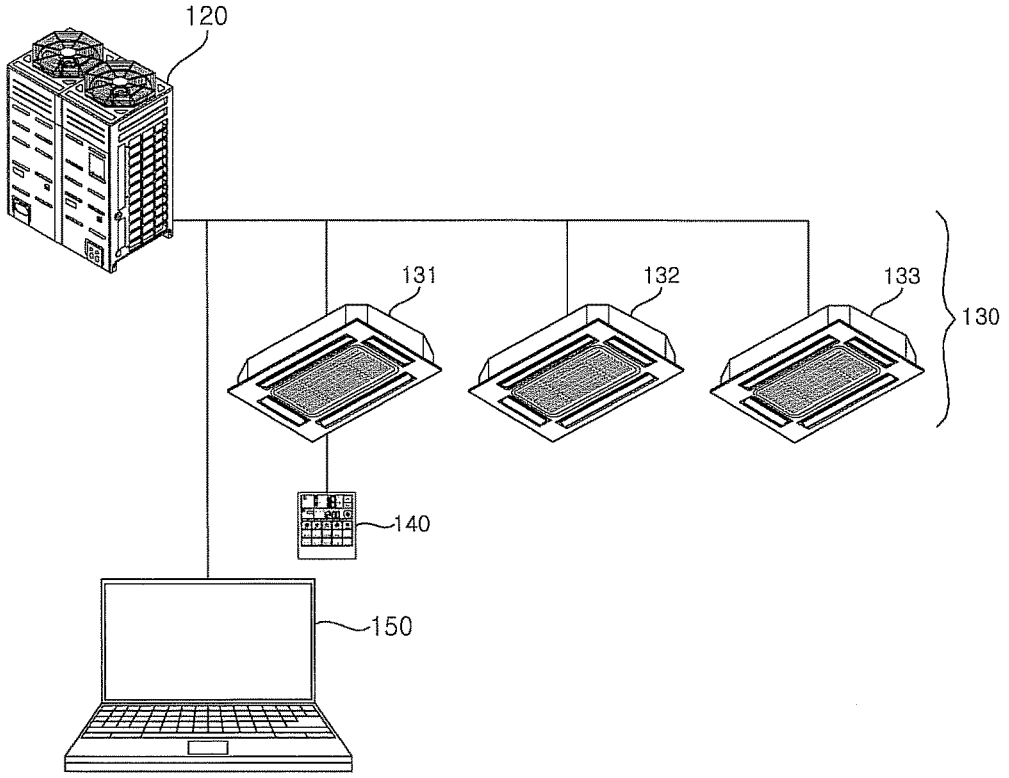
Figure 3:
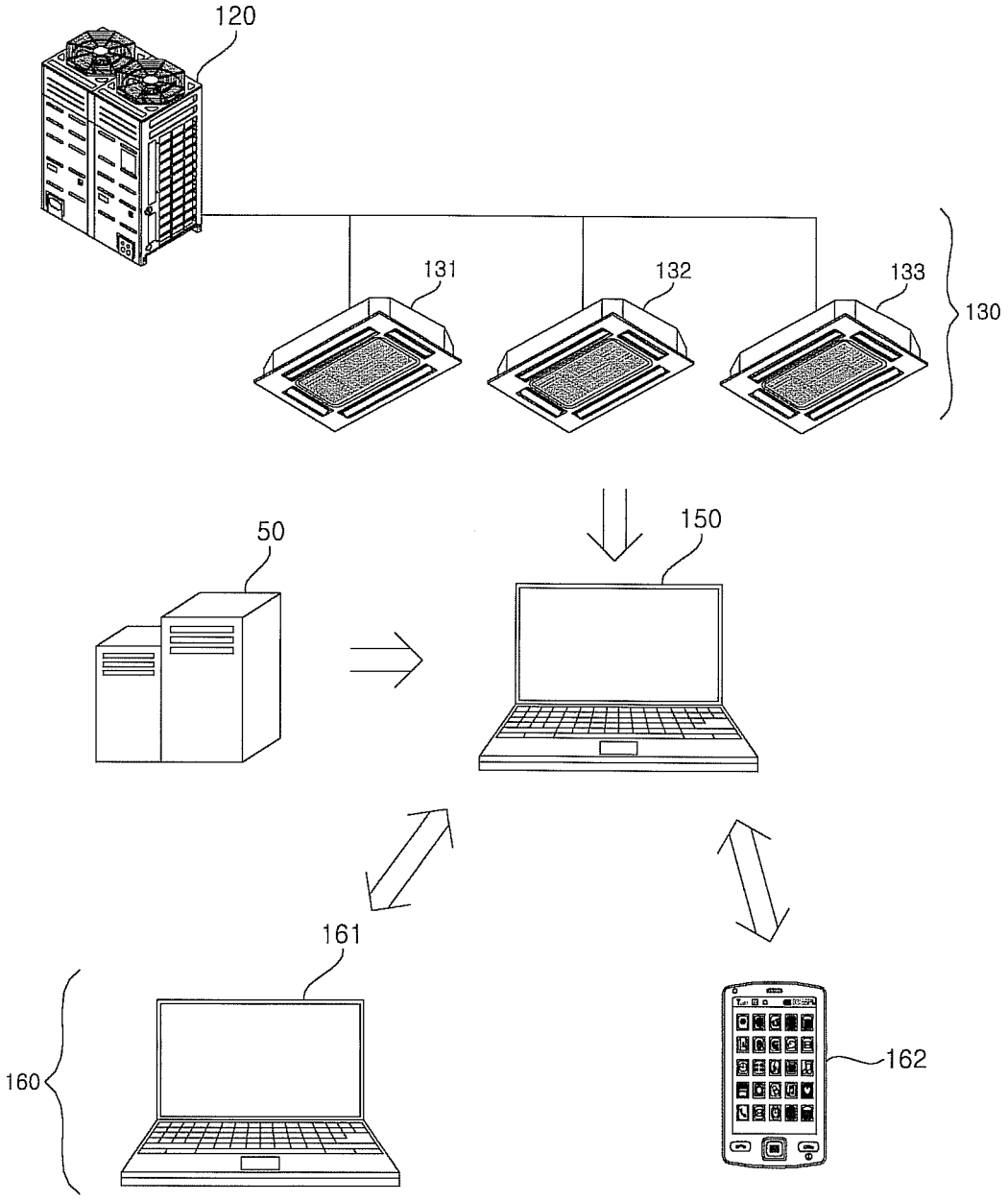

FIGS. 1 to 3 are schematic diagrams of an air conditioner system including a control apparatus in accordance with embodiments. Referring to FIG. 1, the air conditioner system in accordance with embodiments may include an indoor unit or device 130, an outdoor unit or device 120, a central controller 110, a remote controller 140, and a control apparatus 150. In addition to the indoor device and the outdoor device, the air conditioner system may also include a ventilator, a defroster, a humidifier, a heater, and a showcase.

The control apparatus 150 may be a microcomputer including software connected to the indoor device 130 or the outdoor device 120, with or without wire, to control the indoor device 130 or the outdoor device 120. The remote controller 140 may be connected to the indoor device 130 or the outdoor device 120, with or without wire, for transmission of a control signal.

The central controller 110 may be connected to the indoor device 130 and the outdoor device 120 to transmit/receive data thereto/therefrom to monitor and control operation thereof. The central controller 110 may include an input to input an order or command thereto, and an output to display control data or information.

The input of the central controller 110 may include, for example, a mechanical button, or a touch pad to sense a touch input. The output of the central controller 110 may include a device that emits light, such as a Light Emitting Diode (LED), or an Organic Light Emitting Diode (OLED).

The central controller 110 may include a microprocessor to process information, and transmit/receive a control signal for information processing. As shown in FIG. 1, the central controller 110 may be connected to the indoor device 130 and the outdoor device 120, and may communicate with the indoor device 130 and the outdoor device 120 with or without wire.

The central controller 110 may control the indoor device 130 and the outdoor device 120 individually. For example, in order to control the indoor device 130, the central controller 110 may perform a central control locking to cut off operation of the remote controller 140, which may control each of the plurality of indoor device 130. In such a case of the central control locking of the multi air conditioner system, the central controller 110 may transmit a signal to limit input to the remote controller 140, to the remote controller 140, the indoor device 130, or the outdoor device 120.

The air conditioner, being a room cooling/heating system that cools a room, or heats the room by an operation opposite to the room cooling using a repetitive operation of drawing warm air from the room, heat exchanging the warm air thus drawn with a low temperature refrigerant, and discharging the air thus heat exchanged to the room, is an apparatus that forms a series of cycles using a compressor-condenser-expansion valve-evaporator arrangement.

The air conditioner may be divided into the outdoor device 120 installed mostly outdoor, and the indoor device 130 installed mostly indoor. The outdoor device 120 may have the condenser and the compressor mounted therein, and the indoor device 130 may have the evaporator mounted therein. The outdoor device 120 and the indoor device 130 may be connected to the central controller 110 to receive a control signal. The indoor device 130 may include a plurality of indoor devices. The plurality of indoor devices 130 may be individually connected to the control apparatus 150 to receive a control signal to perform an operation corresponding thereto.

If data information is requested from or by the control apparatus 150, the outdoor device 120 may transmit the data information thus requested. Depending on contents of the request from the control apparatus 150, contents of the data information transmitted may vary. For example, the outdoor device 120 may vary the data information to be transmitted based on a requested time; however, embodiments are not so limited.

The outdoor device 120 may include a storage medium (not shown) to store the data information. The outdoor device 120 may store the data information, including operation states, periodically. In one case, the outdoor device 120 may receive a storage period, or a storage time period to store the data information from the control apparatus 150. If an error occurs, the outdoor device 120 may extend the storage time period of the data information recently stored or being stored. For example, if an error occurs, the outdoor device 120 may store the data information recently stored separate from other information. The storage medium (not shown) may include, for example, an Electronically Erasable and Programmable Read Only Memory (EEP-ROM).

The indoor device 130 may communicate with the control apparatus 150 with or without wire. The indoor device 130 may include a communication module for communication with the control apparatus 150 with or without wire.

If the data information is requested from or by the control apparatus 150, the indoor device 130 may transmit the data information thus requested. The indoor device 130 may vary contents of the data information transmitted in accordance with contents of the request from the control apparatus 150. For example, the indoor device 130 may vary the data information transmitted according to a time requested by the control apparatus 150.

The indoor device 130 may receive a control signal from the control apparatus 150. If the control signal is received from the control apparatus 150, the indoor device 130 may report completion of reception of the control signal to the control apparatus 150, for example, and this may vary based on a communication system employed by the air conditioning system.

Upon reception of the control signal, the indoor device 130 may carry out an operation corresponding thereto. The indoor device 130 may receive a storage period, or a storage time period for storing a data signal, including an operation state, from the control apparatus 150. The indoor device 130 may store the data information periodically, or if an error occurs.

If an error occurs, the indoor device 130 may extend a storage time period of the data information recently stored or being stored. The indoor device 130 may include a storage medium (not shown) for storage of the data information. The storage medium may include, for example, an Electronically Erasable and Programmable Read Only Memory EEP-ROM. For example, the indoor device 130 may store the data information periodically, and, if an error occurs, the indoor device 130 may store the data information recently stored separate from other information, for example.

The data information may include the operation state of the indoor device 130 or the outdoor device 120. For example, the data information may include, for example, an air temperature, a condensing temperature, an evaporation temperature, a discharge temperature, and a heat exchanger temperature, as well as any other information related to the operation of the indoor device 130 or the outdoor device 120.

The indoor device 130 may transmit the data information including the operation state to the control apparatus 150. Whether the indoor device 130 is turned on or off, whether the operation state of the indoor device 130 changes, or if an error occurs, the indoor device 130 may transmit data information indicating such to the control apparatus 150. If an event takes place, or at fixed intervals, the indoor device 130 may communicate with the control apparatus 150.

The remote controller 140 may control the indoor device 130 with or without wire. The operation of the remote controller 140 may be limited by the central controller 110. The remote controller 140 may control the operation state of the indoor device 130. The indoor device 130 may control one or more of the plurality of indoor device 130; however, embodiments are not so limited.

The air conditioner system may include the control apparatus 150. The control apparatus 150 may control the indoor device 130 and the outdoor device 120. The control apparatus 150 may change an operation mode of the indoor device 130. The operation mode may include modes of room cooling, dehumidifying, air cleaning, or room heating.

The control apparatus 150 may receive detailed cycle data from the air conditioner in real time to enable problem diagnosis on the air conditioner and display the cycle data on a screen.

The control apparatus 150 may display the data information received from the indoor device 130, the outdoor device 120, or another control device (not shown). The control apparatus 150 may display the data information in various modes. For example, the control apparatus 150 may display the data information in a mode of setting forth numerical values, or display the operation state of a device to be controlled in a time series of images, or a graph.

If there is an input intended to determine the operation state of a domestic appliance the control apparatus 150 is to control, the control apparatus 150 may transmit to the domestic appliance a signal for requesting the data information. The control apparatus 150 may select the outdoor device 120 or the indoor device 130 for which data information is intended to be determined.

If the data information is displayed in characters, such as numerals, the control apparatus 150 may display the data information on the indoor device 130, the data information on the outdoor device 120, and valve information on a pipeline that connects the indoor device 130 to the outdoor device 120. Depending on embodiments, if the valve information is displayed, the control apparatus 150 may display opened or closed valve information in color or with graphics. For example, the control apparatus 150 may display an opened valve in blue, a closed valve in gray, or display forms of the opened valve and the closed valve with graphics; however, colors or graphics are not limited to those described above.

If the data information is to be displayed using a graph, the control apparatus 150 may select a data value associated with a graph. For example, the control apparatus 150 may display a plurality of operation information buttons on a top side of a region where a graph is displayed, and if any one of the plurality of operation information buttons is selected, a data value matched to the operation information button thus selected may be displayed in the graph. For example, the plurality of operation information buttons may correspond to a pressure of the outdoor device 120 or the indoor device 130, a temperature of the outdoor device 120 or the indoor device 130, a discharge pressure from the compressor, an EEV opening, and a fan speed, respectively.

If the data information is displayed in time series images, the control apparatus 150 may select the outdoor device 120 or the indoor device 130 intended to display. If the control apparatus 150 selects one of a plurality of outdoor devices 120 intended to be displayed, the control apparatus 150 may select one of plurality of indoor devices 130 connected to the outdoor device 120 thus selected.

If the outdoor device 120 and the indoor device 130 are selected, the control apparatus 150 may receive the data information including the operation state of the indoor device 130 thus selected, and a connection state of the outdoor device 120 thus selected and the indoor device 130 thus selected. The connection state may include, for example, a pipeline connection state, a flow in the pipeline, and on/off of a valve.

The control apparatus 150 may display the operation state of the outdoor device 120 and the indoor device 130 thus selected in a time series, such as changes in a picture or changes in color. The control apparatus 150 may display a state of the pipeline that connects the outdoor device 120 and the indoor device 130 thus selected or a state of the valve.

The control apparatus 150 may display the state of the pipeline that connects the outdoor device 120 and the indoor device 130 thus selected with the change in color according to whether there is a flow in the pipeline or not, or according to a flow direction. The control apparatus 150 may display an on/off of the valve mounted to or in the pipeline connected between the outdoor device 120 and the indoor device 130 with a picture.

The control apparatus 150 may determine the operation state of the indoor device 130 or the outdoor device 120 in real time. If the control apparatus 150 determines the operation state of the indoor device 130 or the outdoor device 120 in real time, the control apparatus 150 may receive the data information and display the data information thus received in real time.

Referring to FIGS. 2A-2B, a connected position of the control apparatus 150 may be varied. That is, referring to FIG. 2A, the control apparatus 150 may be connected to the outdoor device 120. If connected to the outdoor device 120, the control apparatus 150 may receive data stored at or in the outdoor device 120 to determine a state of the air conditioner. In this case, all data may be received through the outdoor device 120.

Alternatively, referring to FIG. 2B, the control apparatus 150 may be connected to a communication line connected to a plurality of indoor devices 131 to 133, or depending on the case, may be connected to one of the indoor devices 131 to 133. The control apparatus 150 connected to the communication line connected to the plurality of indoor devices 131 to 133 may receive, not only the data stored at or in a particular device, but also the data transmitted/received among the plurality of indoor devices 131 to 133 through the communication line. For example, as the control apparatus 150 may receive and display the data transmitted/received between the indoor device 130 and the central controller 110, the control apparatus 150 may also receive and display a control flow of the central controller 110.

As such, depending on modes of connection of the control apparatus 150, that is, depending on a connection of the control apparatus 150 to the outdoor device or the communication line of the indoor device, the data the control apparatus 150 receives and displays may be vary.

Referring to FIG. 3, the air conditioner system may include a plurality of control apparatuses 150 and 160. The plurality of control apparatuses 150 and 160 may include a first control apparatus 150 connected to the air conditioner to collect data, and second control apparatuses 161 and 162 that communicate with the first control apparatus 150 to receive information on the air conditioner. The plurality of control apparatuses 150 and 160 may transmit/receive information in or using a variety of communication systems, and may display the data information in different languages.

The first control apparatus 150 may store and accumulate the received data and may access a separate data server 50, or may request data, if necessary.

Figure 4:
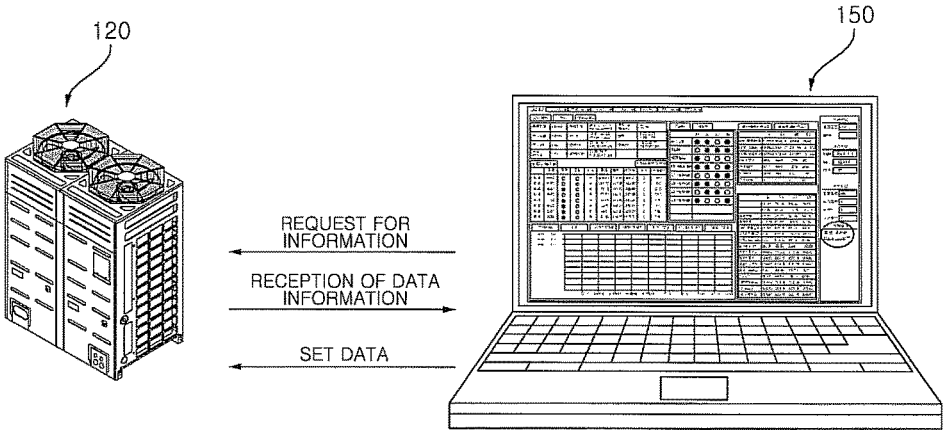
FIG. 4 is a schematic diagram illustrating data flow between a control apparatus in accordance with an embodiment and an outdoor device of an air conditioner.

FIG. 4 is a schematic diagram illustrating data flow between a control apparatus in accordance with an embodiment and an outdoor device of an air conditioner. Referring to FIG. 4, the control apparatus 150 may be connected to the outdoor device 120 to request data, and the outdoor device 120 may transmit the information data on the air conditioner to the control apparatus 150 as requested. In such a case, as described above, the control apparatus 150 may be connected to a communication line of the plurality of indoor devices 131 to 133, and may receive the control signal exchanged between the indoor devices 131 to 133 and the central controller 110 to collect information on the air conditioner.

When the data information is requested from the control apparatus 150, though the indoor device 120 or the outdoor device 130 may transmit the data information to the control apparatus 150, the data transmission is not so limited, that is, the data information may be transmitted to the indoor device 120 or the outdoor device 130 at particular periods or intervals.

Figure 5:
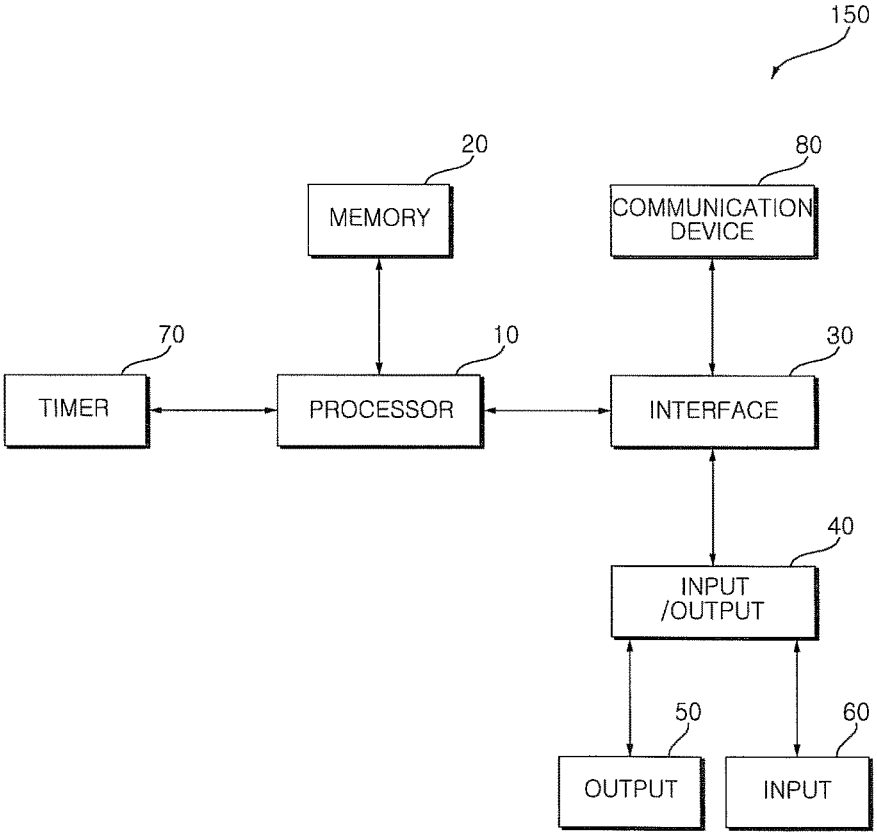
FIG. 5 is a block diagram of a controller in accordance with an embodiment.

FIG. 5 is a block diagram of a control apparatus in accordance with an embodiment. Referring to FIG. 5, the control apparatus 150 may include a processor 10 to process various signals and carry out calculations, a memory 20 to store programs and data in association with the processor 10, and an interface 30 to connect to peripheral devices related to input or output to/from the processor 10. The control apparatus 150 may also include a timer 70, a communication device 80, and an input/output 40 including an output 50 and an input 60.

The processor 10 may carry out different functions for the control apparatus 150, and may run or carry out different software programs and/or sets of command languages stored in the memory 20 to process data. The processor 10 may process signals based on information stored in the memory 20.

For example, the processor 10 may display data stored in the memory 20 on the output 50, or may carry out programs stored in the memory 20. The processor 10 may carry out the programs by calculating a time in association to the timer 70.

The memory 20 may include at least one magnetic disk storage device, a flash memory device, or other non-volatile memory, such as a non-volatile solid memory device. However, embodiments are not so limited, and the memory 20 may include a readable storage medium. For example, the memory 20 may include an Electronically Erasable and Programmable Read Only Memory (EPP-ROM). The EEP-ROM may have information written or erased by the processor 10 during operation of the processor 10. The EEP-ROM may be a memory device, which may maintain information stored therein without being erased even if power to the control apparatus 150 is turned off to cut off power supply.

The memory 20 may store different programs and data stored therein in association with the processor 10. The programs the memory 20 has stored therein may be run by the processor 10.

If there is an input to the input apparatus 60 to determine the operation state of a domestic appliance the control apparatus 150 controls, the processor 10 may control the communication device 80 to receive the data information, which is operation information of the domestic appliance and to display the data thus received/transmitted. In such a case, the data being displayed on a screen may be displayed in time series images or characters.

If one outdoor device 120 is selected to be inspected through the input 60, the processor 10 may receive data information from the outdoor device 130 thus selected, and from one of the plurality of indoor devices connected to the outdoor device thus selected. In this case, the information may include the operation state of the indoor device thus selected and connection states of the outdoor device thus selected and the indoor device thus selected.

The processor 10 may receive information, and may display the operation states of the outdoor device thus selected and the indoor device thus selected, and the connection states thereof. The processor 10 may further receive information on the outdoor device or the indoor device in real time, and may display the information in images or characters in real time through the output 50. In such a case, the processor 10 may display the received data in a set language, or in a language other than a language stored therein.

The processor 10 may set a data storage time period or storage period of the outdoor device or the indoor device, and transmit the same to the outdoor device and the indoor device. The indoor device and the outdoor device may store the data according to the setting, and erase the data at a length of a storage time if the time period has passed.

In displaying the information on the outdoor device and the indoor device, the processor 10 may display data in real time or change the data in an order of times in succession if the data is produced before a fixed time. In such a case, the processor may display information regarding components of the indoor device or the outdoor device, for example, valve, pressure, and temperature of the pipeline, and states of the heat exchanger and the compressor in images or moving images, and depending on the case, the operation state, in different colors.

For example, a fan operation state of the indoor device may be displayed in or as a rotating image of rotation blades, and a rotation speed of the fan may be displayed in or as a numerical value or a color. If the pipeline has a flow of a fluid therein, the flow may be displayed divided into a blue color and a red color depending on a temperature thereof, and a valve on/off may be displayed in a valve form and a color change, through the output 50.

If the processor 10 is to display the data thus received, the processor 10 may display the data, re-producing the data according to time, while controlling a display speed thereof. That is, in displaying changes in the information with time, the display speed may be controlled according to passing time.

The interface 30 may connect the input and output peripheral devices to the processor 10 and the memory 20. In such a case, the processor 10, the memory 20, or the interface 30 may be embodied on a single chip, for example, or they may be embodied on individual chips.

The timer 70 may check time. The processor 10 may determine whether a predetermined time has passed using the timer 70 to carry out a control. For example, the timer 70 may calculate a re-producing rate of the images; however, embodiments are not so limited, as there may be different embodiments.

The input/output 40 may connect peripheral devices, such as the output 50 and the input 60, to the interface 30 to relay and control input/output of data. Depending on the case, the input/output 40 may include an input/output controller (not shown) to control the output 50 and/or the input 60.

The output 50 may include a speaker that emits sound, or a display that emits light to make a visual display. The input 60 may include means to receive an external input, such as a physical button, a dial, a slider switch, or a click wheel, for example. The output 50 may include at least one of a Light Emitting Polymer Display (LPD), a Liquid Crystal Display (LCD), a Thin Film Transistor-Liquid Crystal Display (TFT-LCD), a Organic Light-emitting Diode (OLED), a flexible display, or 3D display; however, embodiments are not so limited, and may include a variety of systems.

The output 50 may display information for controlling a component device to which the control apparatus 150 is connected. If the control apparatus 150 is applied to an air conditioner system, the output 50 may display information required for air conditioning. For example, the output 50 may display operation modes of the air conditioner, such as room cooling, room heating, dehumidifying, or air cleaning of the air conditioner, and may display a room temperature, a wind direction, and the presence of a heat source in a room.

The output 50 may be a touch sensing touch screen. In this case, the output 50 may be fabricated as one unit with the input. The touch sensing touch screen may display a visual output to a user, and may receive input from the user by sensing a touch. The visual output may include, for example, graphics, a text, an icon, a video, or a combination thereof. If the output 50 includes the touch sensing touch screen, buttons on the input 60 discussed below may be replaced with user interfaces (visual buttons) displayed on the touch screen.

The input 60 may include, for example, at least one button, or switch, and depending on the case, may include a touch pad that perceives an input by pressure or static electricity. The input 60 and the output 50 may be controlled by an input/output controller (not shown) in the input/output 40. The input 60 and the output 50 may include a plurality of interfaces or buttons corresponding to instruction words to carry out programs stored in the memory 20, or functions discussed above.

The communication device 80 may be connected to the indoor device 130, the outdoor device 120, and the interface 30 to receive a control signal from the interface 30 and transmit the control signal to the indoor device 130 or the outdoor device 120, and receive operation states from the indoor device 130 or the outdoor device 120. If the communication device 80 wirelessly communicates with the indoor device 130 or the outdoor device 120, the communication 80 may include a RF (Radio Frequency) circuit. The communication device 80 may transmit/receive the RF signal which is an electro-magnetic signal. The RF circuit may convert an electric signal to an electro-magnetic signal, and may communicate with a communication network and other communication devices with the electro-magnetic signal.

For example, the RF circuit may include an antenna system, an RF transceiver, at least one amplifier, a tuner, at least one oscillator, a digital signal processor, a CODEC chip set, and a memory, and may include known circuits to carry out functions. Moreover, the communication device may use a wireless communication system selected from, but not limited to, Bluetooth, Radio Frequency Identification, IrDA (Infrared Data Association), Ultra Wideband, ZigBee, and Wi-Fi.

The communication device 80 may receive a signal from the processor 10 through the interface 30. If the communication device 80 receives a control signal from the interface 30, the communication device 80 may modulate the control signal and transmit the signal thus modulated to the indoor device 130 or the outdoor device 120.

Figure 6:
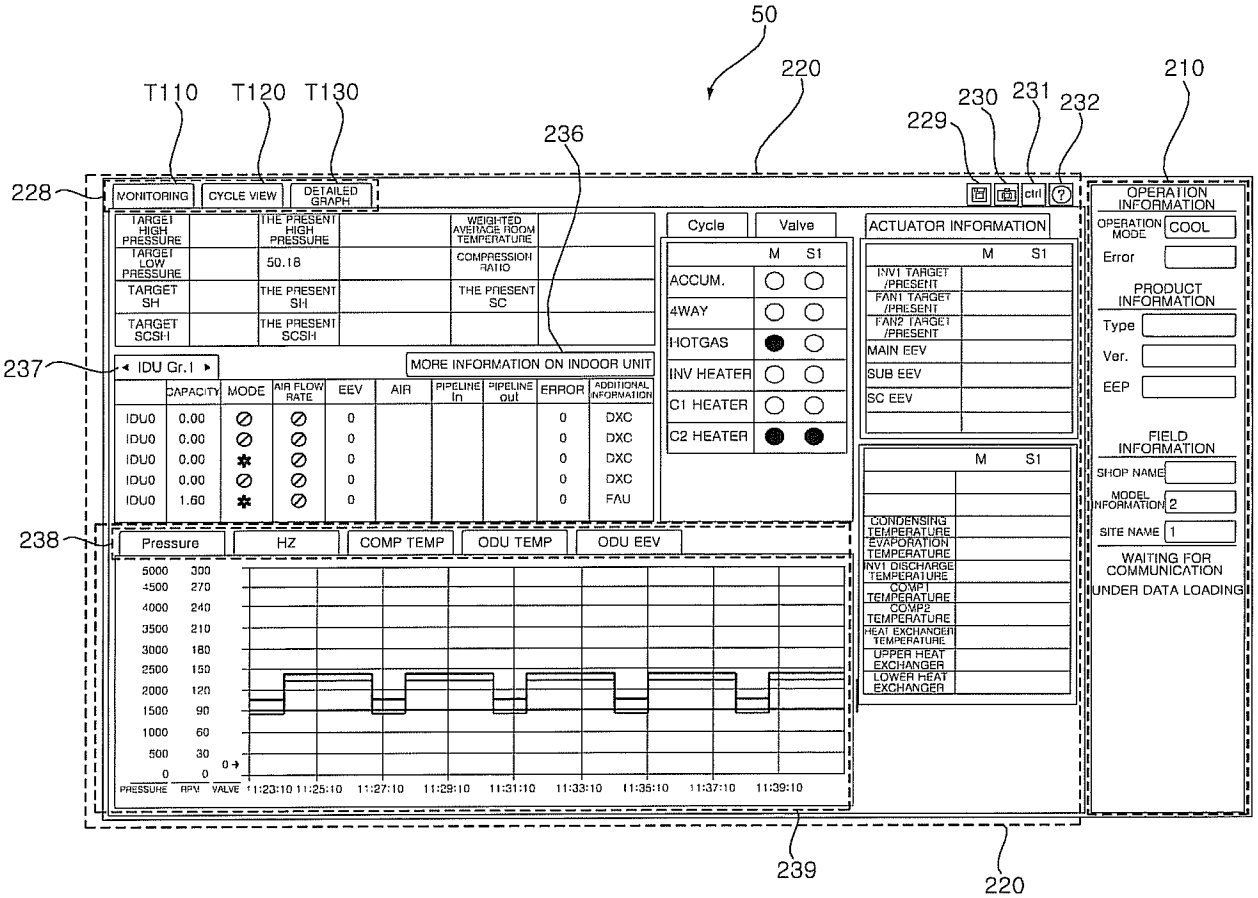
FIG. 6 is an exemplary view illustrating a frame for monitoring an air conditioner displayed on a control apparatus in accordance with an embodiment.

FIG. 6 is an exemplary view illustrating a frame for monitoring an air conditioner displayed on a control apparatus in accordance with an embodiment. The control apparatus 150 may receive information on component devices including the outdoor device and the indoor device and forward the information through the output 50.

In such a case, referring to FIG. 6, the output 50 may display information on a plurality of the component devices connected to the control apparatus 150, including the outdoor device and the indoor device.

The output 50 may display the information on the component devices on a frame, dividing the frame into a monitoring window 220 and an information display window 210. The monitoring window 220 may include an additional menu button 228 to display, in addition to a monitoring button T110, a cycle view button T120, and a detailed graph button T130. If these respective buttons are selected, a cycle view window and a detailed graph window may be displayed on the frame together with additional menus.

Further, the monitoring window 220 may have a plurality of function buttons displayed thereon. The function buttons may be, for example, a storage button 229, a still shot button 230, a control button 231, and/or a help button 232.

When the storage button 229 is selected, a plurality of data presently displayed by the output 50 may be stored, together with time information. The still shot button 230 may store data presently displayed on the monitoring window 220 and the information display window 210 with the appearance of the frame in a still shot image.

When the control button 231 is selected, a storage period of the data thus monitored, and a storage time period of the data for one storage period may be set. In this case, selection of a button is not required, rather, the data may be stored, periodically. A change in language displayed on the monitoring window 220 and the information display window 210 is possible. Further, frame settings may be corrected, and a size of image stored when a still shot is selected may be set. Moreover, when the control button 231 is selected, a control setting for the plurality of component devices may be possible.

The monitoring window 220 may have individual information and group information on one of the plurality of component devices displayed thereon, and information on a particular device selected at the monitoring window 220 may be displayed on the information display window 210.

The monitoring window 220 may have the plurality of component devices sorted, and information on the plurality of component devices sorted in or corresponding to a plurality of the buttons or taps, such that, if one of the buttons is selected, information on one of the plurality of component devices may be displayed on the frame. The monitoring window 220 may be divided into a plurality of regions to display data in the plurality of regions different from one another. The monitoring window 220 may display basic operation information, group, and individual device information for the plurality of component devices, cycle information, measured data values, and an operation graph window 239 for each device.

In the basic operation information, a control target value on a pressure or a temperature of the presently displayed device, for example, the air conditioner, and data being measured presently may be displayed. In the group and individual device information, a group selection button 237 may be provided to enable selection of a group intended to be displayed, and information on an individual device in the group may be displayed in a list. If there are contents in an additional information item, an additional information button 236 may additionally display information on a special indoor device on an additional window.

In the cycle and measured data information, whether each function of a master outdoor device and slave outdoor devices is operating or not may be displayed, and measured values thereof may be displayed. Further, information on the fan and the valve, and information on a discharge temperature of the compressor, a condensing temperature and evaporation temperature of the heat exchangers may be displayed.

For example, the target pressure, the present pressure, a compression ratio, a room temperature, operation of each element, whether the valve of the outdoor device 120 is in operation or not may be displayed, and a pressure of the outdoor device 120 or the indoor device 130, a temperature of the outdoor device 120 or the indoor device 130, and a discharge pressure of the compressor, an EEV opening, and a fan speed may be displayed.

In the operation graph window 239, the pressure of the compressor, an operation frequency, a compressor temperature, a temperature of the outdoor device, operation of an outdoor device valve may be selected with respective selection buttons 238, to display a graph on each item of the device thus selected. The operation graph window 239 may display a plurality of pieces of information divided into colors different from one another, or thicknesses or line forms different from one another. Also, the information displayed on the operation graph window 239 may be displayed when the detailed graph button T130 is selected, but may be displayed in more detail.

In the information display window 210, if one of the devices displayed in the group information is selected, an operation mode, whether an error occurs or not, a kind of error, and product information on a product type or version of the device may be displayed, together with information on a position of the device thus selected. In the information display window 210, a communication state with the device thus selected may also be displayed.

Figure 7:
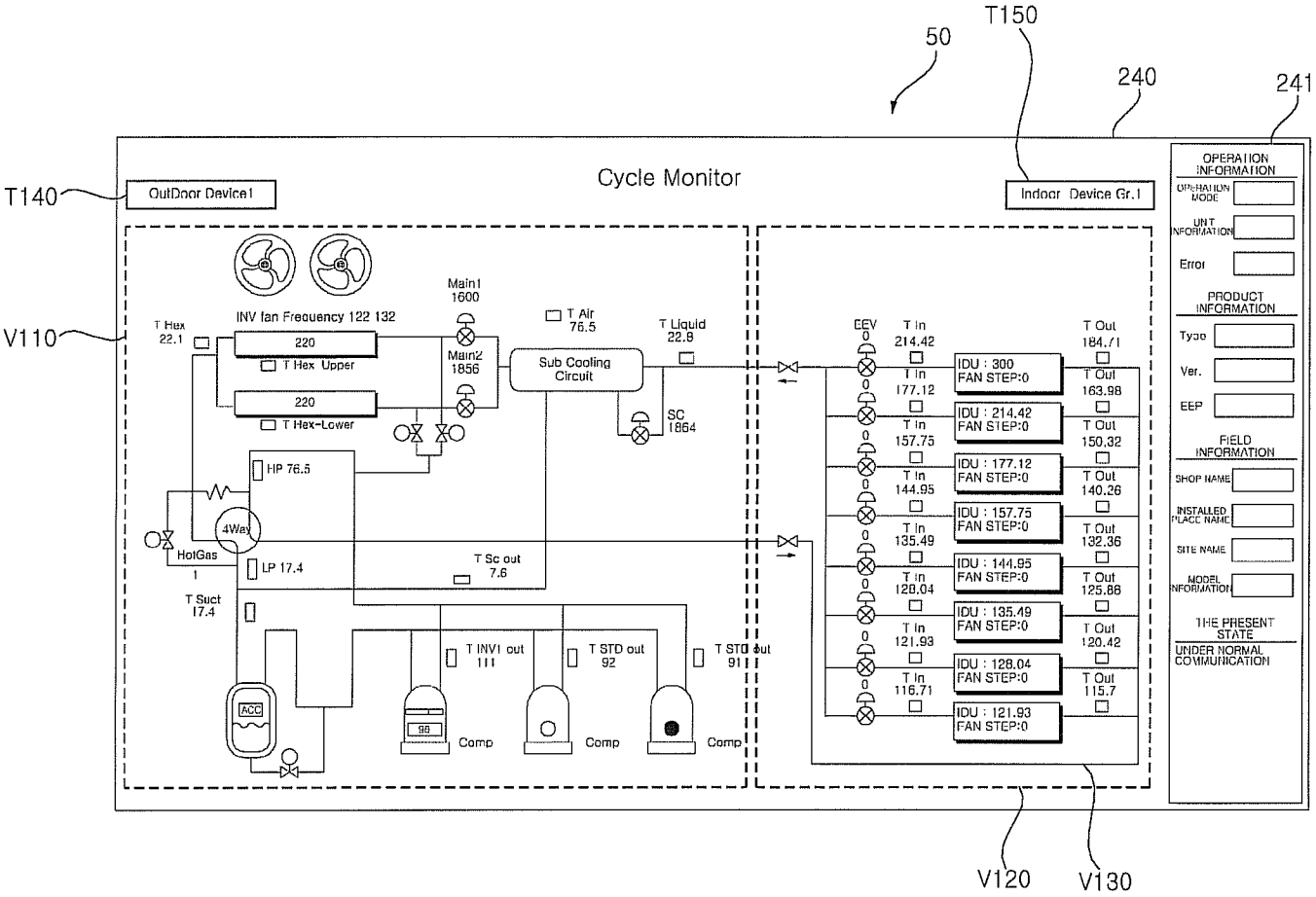
FIG. 7 is an exemplary view illustrating a cycle frame of an air conditioner displayed on a control apparatus in accordance with an embodiment.

FIG. 7 is an exemplary view illustrating a frame for monitoring an air conditioner cycle displayed on a control apparatus in accordance with an embodiment. Referring to FIG. 7, the processor 10 may display information on a cycle of the air conditioner on a screen of the output 50 in or as an image.

If the cycle view button T120 is selected from the menu buttons in FIG. 6 discussed above, the cycle information may be displayed on a cycle view frame 240 displayed on the output 50. The cycle view frame 240 may arrange the component devices of the air conditioner matched or corresponding to actual connection states and installed positions, to display the present operation states thereon.

Each of the component devices may be displayed in or as an image, an icon, or a symbol which represents the component device, and the operation state of each of the component devices may be displayed in or as a color, a moving image, a character, or a numeral, for example.

The cycle view frame 240 may display cycle data changed in real time matched or corresponding to the data on the operation state of the component device of the air conditioner. For example, an outdoor device fan or an indoor device fan may be displayed in an image of a rotating fan, and if the fan image does not move (does not rotate), it may be determined that the fan is in a turned off state. Also, the operation state of the compressor may be displayed in a color, for example, in red and green.

The cycle view frame 240 has an outdoor device selection button T140 and an indoor device selection button T150 for, if a particular outdoor device is selected from the plurality of outdoor devices of the air conditioner, displaying information on the outdoor device thus selected, as well as the cycle data of devices connected to the outdoor device thus selected. Moreover, the cycle view frame 240 has an outdoor device region V110 and an indoor device region v120 displayed on the divided cycle view frame 240. For the indoor devices, information on a distributor connected to the indoor devices may be displayed all together, and in relation to this, a pipeline connection state V130 between the distributor and the indoor devices may also be displayed.

If one or a group of the indoor devices is selected from the plurality of indoor devices, the cycle information or data on the one or the group of the indoor devices thus selected may be displayed, together with information or data on the outdoor device to which the one or the group of the indoor devices thus selected is connected. As the control apparatus 150 is connected not to a single outdoor device, and a single indoor device, the control apparatus 150 may display cycle information on devices or groups of devices selected from the plurality of component devices.

If a particular device is selected at the cycle view frame 240, for example, the compressor is selected, an operation information window 241 may display the operation information, product information, and information on an installed site of the compressor.

If one of the plurality of component devices has something wrong with it, whether an error occurs or not may be displayed in a change of or in color or image, and a warning message may also be displayed on the cycle view frame 240. Error information may also be displayed on the operation information window 241.

Figure 8A:
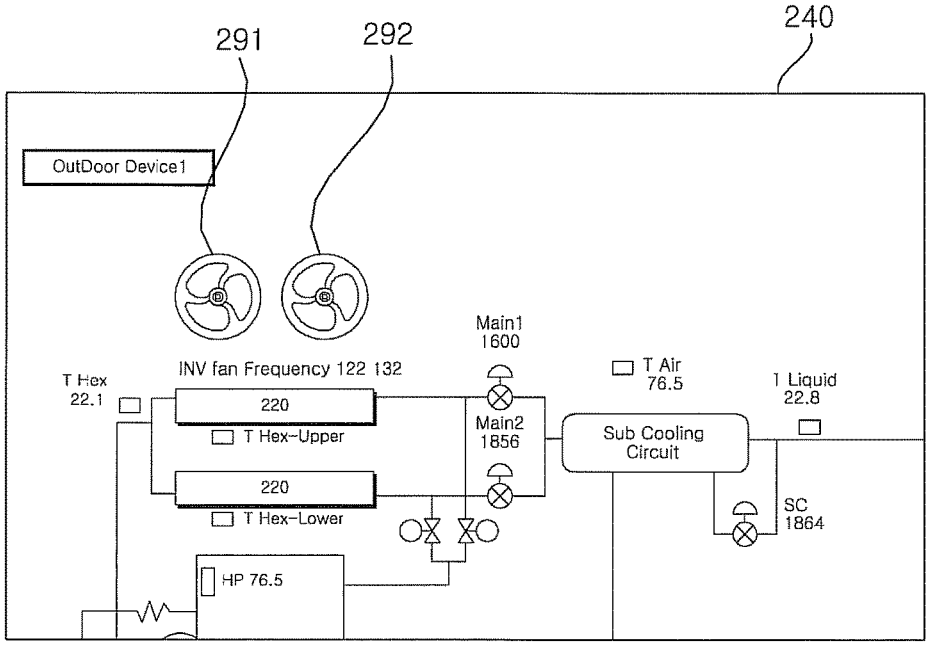
FIGS. 8A and 8B are exemplary views each illustrating a cycle view frame displayed on a control apparatus in accordance with an embodiment.
Figure 8B:
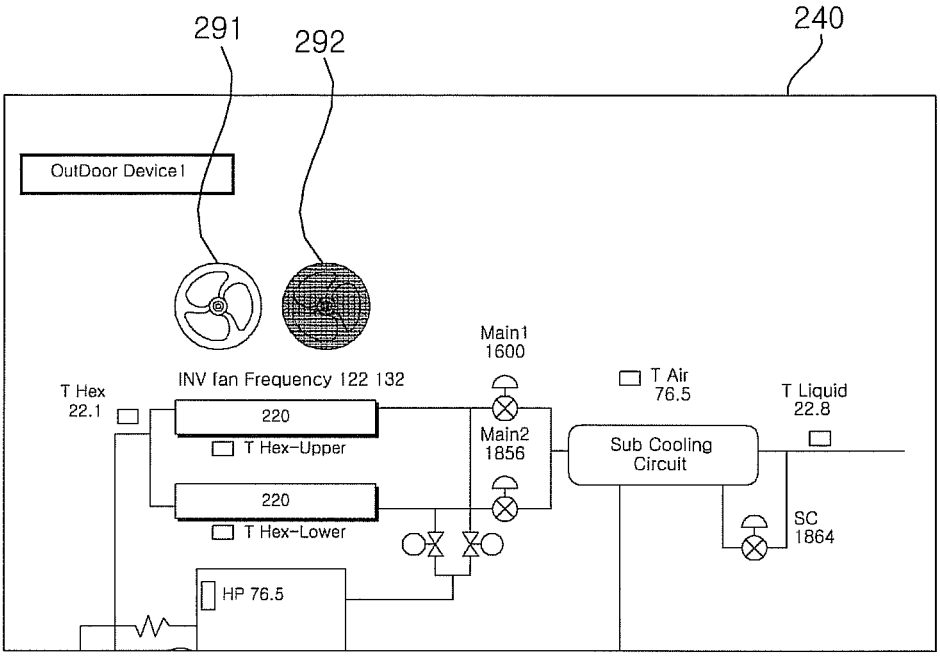

FIGS. 8A and 8B are exemplary views each illustrating a cycle view frame displayed on a control apparatus in accordance with an embodiment. Referring to FIGS. 8A and 8B, the cycle view frame 240 may display information on the operation state of one component device. More particularly, if something goes wrong, such as an error occurs, the cycle view frame 240 may display error states of respective component devices. Further, the control apparatus 150 may issue an alarm, or a warning message. For example, referring to FIG. 8A, outdoor device fans in the outdoor device may be displayed on the cycle view frame 240, and the outdoor device fans 291 and 292 may be displayed changed on the cycle view frame 240 to match operation states of the actual outdoor device fans. The outdoor device fans may be displayed on the cycle view frame 240 to match a number of the outdoor device fans.

If the actual outdoor device fans in the air conditioner rotate, the outdoor device fans 291, and 292 on the cycle view frame 240 matched or corresponding to the actual outdoor device fans may also be displayed in or as rotating images, rotating in or at a higher or lower speed according to a change of or in the rotating speed, respectively. If, of the two outdoor device fans, something wrong or an error occurs at the second outdoor device fan, a warning regarding the error state may be displayed at or associated with the second outdoor device fan 292 displayed on the cycle view frame 240.

On the cycle view frame 240, the first outdoor device fan 291 which is in a normal rotation state may be displayed in an image rotating normally, and the second outdoor device fan 292 having something wrong with it may have the warning displayed thereon. The warning may be displayed by displaying a color of the second outdoor device fan 292 different from a color of the first outdoor device fan 291. Alternatively, a popup window may be produced to output the warning message, or an additional alarm may be issued by the control apparatus 150. For example, the first outdoor device fan 291 in a normal state may be displayed in or as green, and the second outdoor device fan 292 having something wrong with it may be displayed in or as red. Alternatively, the second outdoor unit fan 292 may be displayed in an image which is not rotating, but rather, stopped. Not only the outdoor device, but also the compressor, the sensor, and the valve may be displayed with a change in color or an additional alarm may be issued, if something is wrong with it or an error occurs.

Figure 9A:
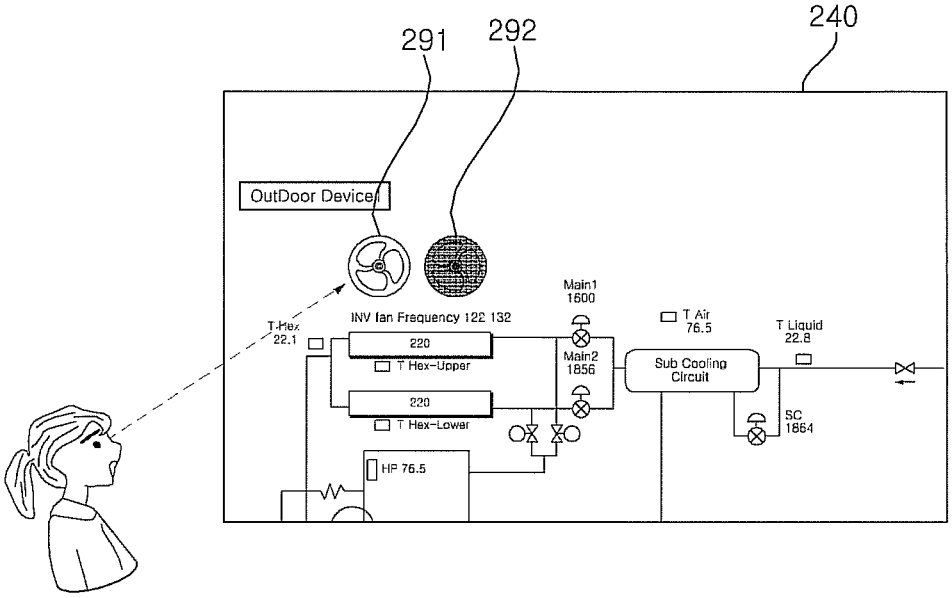
FIGS. 9A and 9B are exemplary views each illustrating inspection of an air conditioner using a cycle view on a control apparatus in accordance with an embodiment.
Figure 9B:
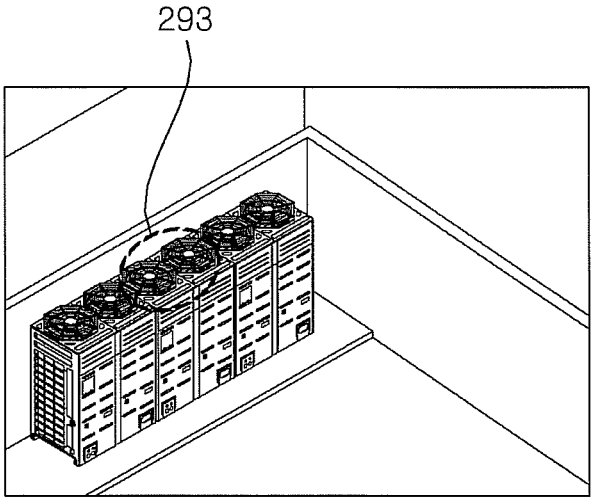

FIGS. 9A and 9B are exemplary views each illustrating inspection of an air conditioner using a cycle view on a control apparatus in accordance with an embodiment. If an error occurs at a device, the control apparatus 150 may display a warning regarding the error on the cycle view frame 240. As discussed above, the warning may be a change of or in an image, a symbol, a form, or a color of an icon matched or corresponding to the device, data on an error state may be displayed, and depending on the case, a warning message may be displayed. An alarm may also be issued.

Referring to FIG. 9A, if the warning is output on the cycle view frame 240, a user of the control apparatus 150 may determine that the device has an error by viewing the cycle view frame 240. In this case, the device displayed on the cycle view frame 240 may be displayed matched or corresponding to an installed position thereof, and if the device having something wrong with it is selected, information on the installed position may be displayed on the cycle view frame 240. For example, of the two outdoor device fans, if the second outdoor device fan has something wrong with it, as shown in FIG. 9B, an actual position 293 of the second outdoor device fan may be determined and the second outdoor device fan may be inspected or repaired.

Figure 10A:
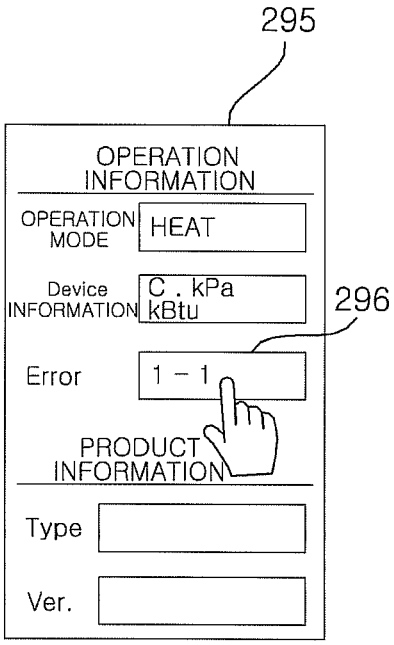
FIGS. 10A and 10B are exemplary views each illustrating a cycle view frame on a control apparatus in accordance with an embodiment, displaying an error.
Figure 10B:
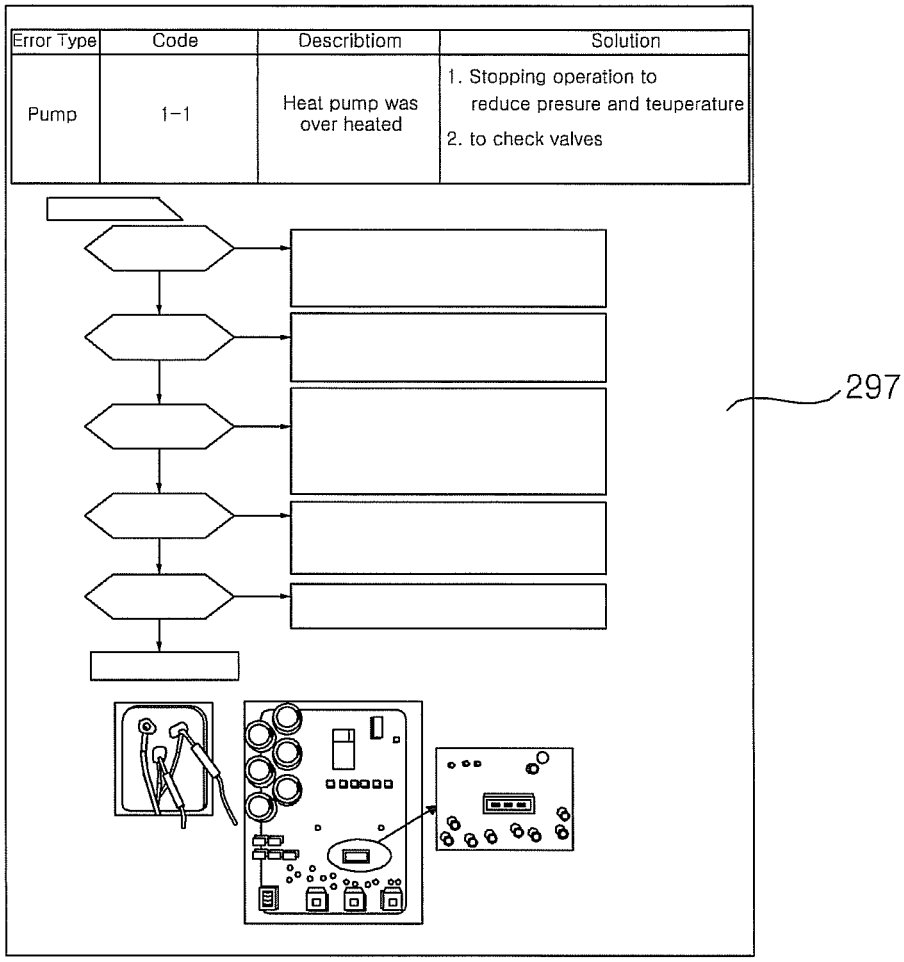

FIGS. 10A and 10B are exemplary views each illustrating a cycle view frame on a control apparatus in accordance with an embodiment, displaying an error. Referring to FIGS. 10A and 10B, operation information 295 may be displayed on the cycle view frame displayed on the control apparatus 150. If something wrong occurs, such as an error, the control apparatus 150 may display information on a device different from a normal state.

In this case, if the device with something wrong with it is selected from the cycle view frame 240, as shown in FIG. 10A, an operation mode, device information on data being displayed, and error information 296 of the device may be displayed on an operation information window 295 provided to or at one side of the cycle view frame 240. Further, a product type and version information on the product may be also displayed, and information on an installed position may also be displayed. From FIG. 10A discussed above, the user may determine the installed position of the actual component device using the operation information window. The error information 296 may be displayed in a code which is a combination of numerals or characters.

Referring to FIG. 10B, upon selection of the code displayed as the error information 296, help information 297 matched or corresponding to the error code may be displayed. The help information 297 may include a description of the error code, a reason why the error code has taken place, a position where the error has taken place, and methods for inspecting and treating the error, and an image to help the user understand and treat the error, which may all be displayed together.

Figure 11:
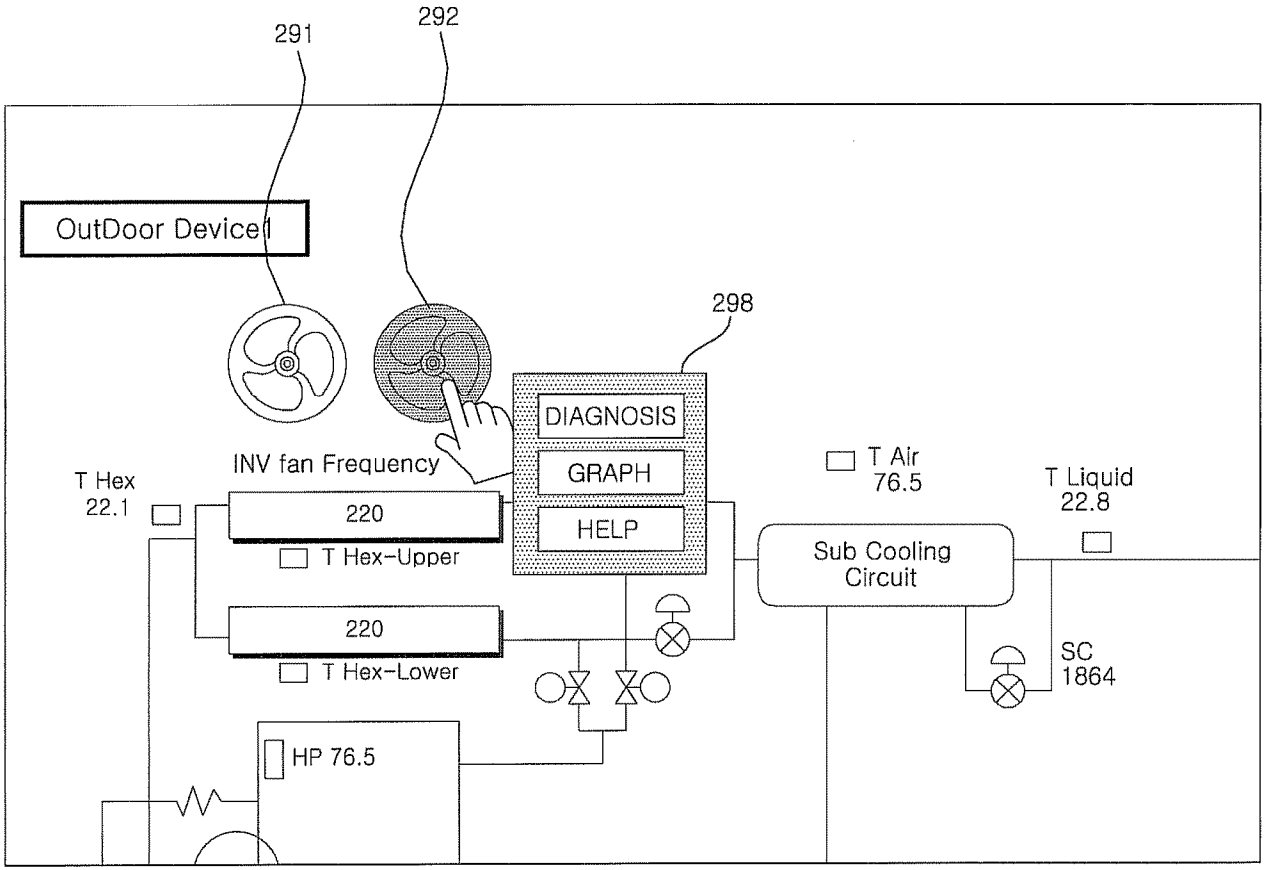
FIGS. 11 and 12 are exemplary views each illustrating information a display on a cycle view frame on a control apparatus in accordance with an embodiment.
Figure 12:
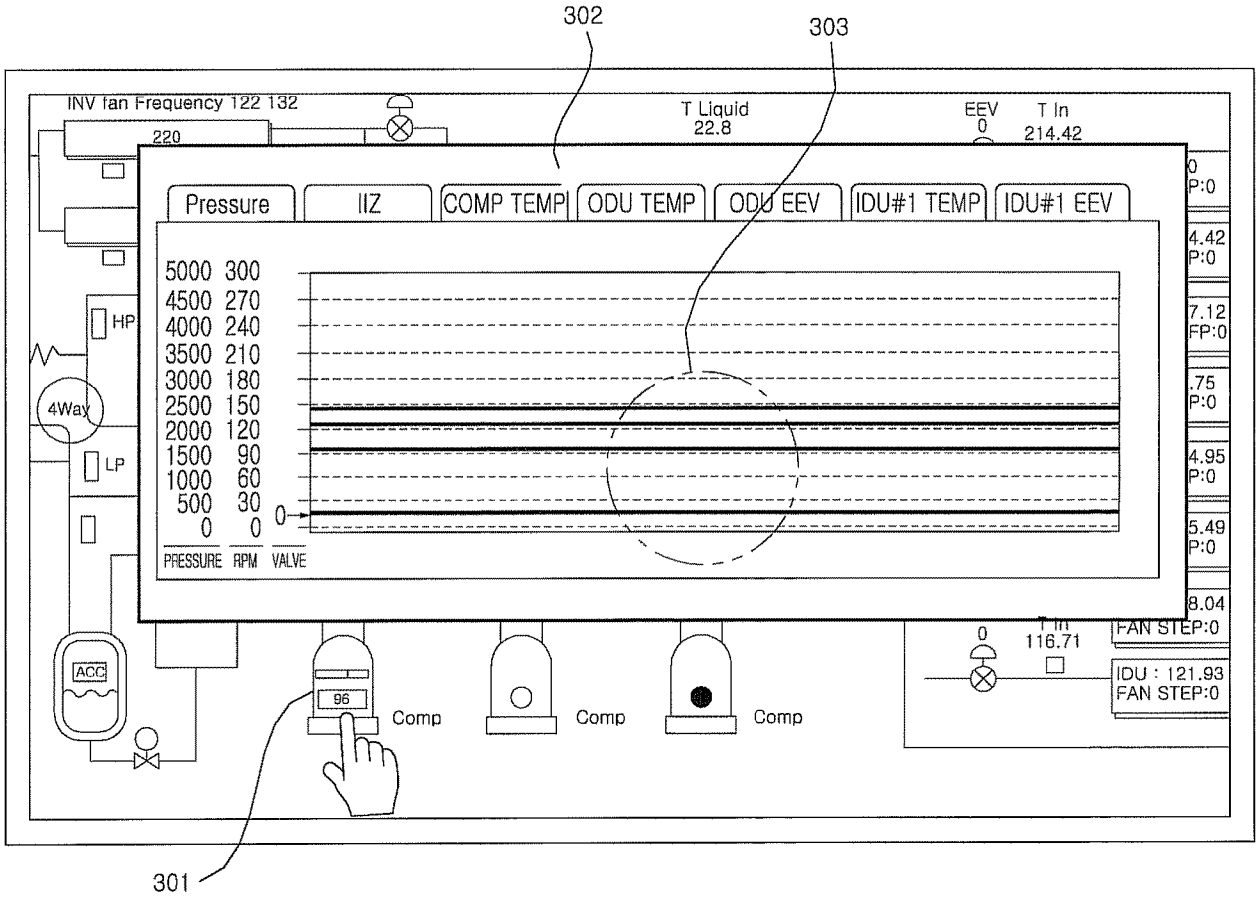

FIGS. 11 and 12 are exemplary views each illustrating information displayed on a cycle view frame on a control apparatus in accordance with an embodiment. Referring to FIG. 11, if the cycle view frame 240 displays a warning for a device for which something has wrong taken place, if the user selects the device having something wrong with it, as discussed above, the operation information may be displayed at or in one region of the frame, and as shown, a sub-menu 298 may be displayed.

The sub-menu 298, being an additional menu on the device having something wrong with it, may include menu items of diagnosis, graph, and help. The diagnosis menu may run a problem diagnosis operation on or for the device having something wrong with it. In this case, upon selecting the diagnosis menu, the device may be subjected to a diagnosis in compliance with a predetermined diagnose logic based on data for the device having something wrong with it, and a result of the diagnosis may be displayed on the frame. The result of the diagnosis may be stored to accumulate the results, and may be transmitted to an external terminal or other control apparatus when requested.

Upon selection of the help menu, a manual data on the device having something wrong with it may be displayed on the frame. And, as discussed above, the error information on the device may be displayed.

Upon selecting the graph menu, operation data for a predetermined time period for the device having something wrong with it may be displayed in a graph based on data for the device. For example, if the device is the outdoor device fan, variations on a rotation speed, whether operated or not, and an input voltage of the outdoor device fan for a predetermined time period may be displayed in or on the graph. Further, if the device is the compressor, variations on an operation frequency, a suction pressure, a discharge pressure, a suction temperature, and a discharge temperature for a predetermined time period may be displayed in the graph.

Referring to FIG. 12, the sub-menu may not be displayed according to characteristics of the device thus selected, but rather, the data on the device thus selected may be displayed in the graph. In this case, the graph may be displayed on a new window, or at a region of the cycle view frame 240. If the compressor 301 is selected, a graph window 302 on the compressor may be displayed on the frame. In this case, of course, not only a pressure of the compressor, and a temperature of the compressor may be displayed, but also information on the outdoor device connected to the compressor, an indoor device side valve control, and a refrigerant temperature in a connected pipeline may also be displayed, all together.

The graph may show changes based on data for a predetermined time period, and the time period may be changed according to a setting.

The control apparatus according to embodiments may easily display an operation state of the air conditioner and information thereof on the cycle view frame easily, for the user to easily determine information on each of the component devices.

Embodiments disclosed herein provide an apparatus for controlling an air conditioner, in which a cycle view may be displayed for making easy notice on cycle information on the air conditioner based on data from the air conditioner, and determining a state of the air conditioner easily to enable to take a countermeasure.

Embodiments disclosed herein provide control apparatus that may include a control unit or controller connected to one of a plurality of equipped apparatuses to monitor and control the plurality of equipped apparatuses. The control unit may receive a cycle data which enables trouble diagnosis on the plurality of equipped apparatuses from the plurality of equipped apparatuses connected thereto thus in real time, display the cycle data on the plurality of equipped apparatuses on a frame, and change the cycle data displayed thus if the data on the plurality of equipped apparatuses changes.

The control apparatus for an air conditioner according to embodiments may permit the user to notice trouble with the air conditioner instantly because the control apparatus stores and manages the data from the air conditioner, and displays the data visually and changes the operation state of the air conditioner with time enabling to determine the state of the air conditioner easily, and permits to improve user's convenience significantly because the control apparatus may display the cycle data on the air conditioner in an image or a code matched to the units of the air conditioner enabling a user to easily determine a flow of an entire structure and general operation of the air conditioner.

Although the apparatus for controlling an air conditioner according to embodiments has been described with reference to the illustrated drawings, it will be apparent to those skilled in the art that embodiments are not intended to be limited to the above-described embodiments and drawings, but various changes or modifications may be made therein without departing from the scope and the technical sprit.

This application relates to U.S. application Ser. Nos. 14/077,423 and 14/077,428, both filed on Nov. 12, 2013, which are hereby incorporated by reference in their entirety. Further, one of ordinary skill in the art will recognize that features disclosed in these above-noted applications may be combined in any combination with features disclosed herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A control apparatus comprising:

a display;

a communication device coupled to at least one of a plurality of component devices of an air conditioner to transmit and receive cycle data, wherein the plurality of component devices includes at least one outdoor device and a plurality of indoor devices connected to the at least one outdoor device, wherein the cycle data includes:

information regarding whether each separate component device of the plurality of component devices is in operation or not, information regarding cycle changes in pressure and temperature in at least one of the plurality of component devices, and an operational state of each of the plurality of component devices; and a processor configured to:

control the plurality of component devices, receive the cycle data, in real time, from the plurality of component devices to enable problem diagnosis on the plurality of component devices, display, in a frame of the display, the cycle data for the plurality of component devices, and to change the cycle data displayed on the display, display a cycle view frame on the display, receive information regarding a selection of a cycle view button displayed on the display, in response to receiving the information regarding the selection of the cycle view button on the display, control the display to display the cycle view frame based on the cycle data of the plurality of component devices, receive information relating to a change of the cycle data, and when the information relating to the change of the cycle data is received, control the display to change the cycle data displayed on the display in real time, wherein the cycle view frame displays:

a connection state of the plurality of component devices, wherein the connection state is displayed at least once by showing a state of a pipe line; and wherein the cycle data is displayed in or as a color, a moving image, a character, or a numeral, wherein the cycle view frame includes an operation information window, and in response to the selection of one component device at the cycle view frame, the operation information window displays:

an operation mode of the selected component device, information regarding whether an error has occurred or not with regard to the selected component device, product information regarding the selected component device, and information regarding the installed site of the selected component device.

2. The control apparatus as claimed in claim 1, further comprising a memory that stores the cycle data, periodically or upon request by a user.

3. The control apparatus as claimed in claim 2, further comprising a timer.

4. The control apparatus as claimed in claim 1, wherein the display includes a touch screen.

5. The control apparatus as claimed in claim 4, wherein the frame, displayed on the display, includes a plurality of buttons by which a user selects additional information.

6. The control apparatus as claimed in claim 5, wherein the plurality of buttons include a plurality of function buttons.

7. The control apparatus as claimed in claim 6, wherein the plurality of function buttons includes a storage button, a still shot button, a control button, and/or a help button.

8. The control apparatus as claimed in claim 1, wherein when one of the plurality of component devices or one of a plurality of components in the one of the plurality of component devices is selected on the frame, the processor displays, on the display, a graph of information on the component device or component thus selected, or operation of the selected component device or component on a newly produced window.

9. The control apparatus as claimed in claim 1, wherein the processor is configured to display, on the display, operation characteristics for each of the plurality of component devices reflected in the cycle data.

10. The control apparatus as claimed in claim 1, wherein when a warning is displayed on the frame and selected by a user, the processor performs a problem diagnosis operation on a component device associated with the warning.

11. The control apparatus as claimed in claim 10, wherein at a time of a problem diagnosis, the processor is configured to provide and display, on the display, a diagnosis report including a cause of a problem, a result of the diagnosis, and a solution to the problem.

12. The control apparatus as claimed in claim 11, wherein at the time of the problem diagnosis, the processor produces a help frame including information regarding the problem diagnosis.

13. The control apparatus as claimed in claim 1, wherein the processor is configured to display, on the display, changes in operation for the plurality of component devices using a graph that changes with time.

14. The control apparatus as claimed in claim 1, wherein upon display and selection of a warning on the frame by a user, the processor displays, on the display, a menu for displaying one of a plurality of frames on diagnosis of the plurality of component devices, on a graph on an operation of the plurality of component devices, or on help for the plurality of component devices.

15. The control apparatus as claimed in claim 1, wherein the processor is configured to cause the cycle data being displayed on the frame to be renewed in real time as the cycle data for the plurality of component devices is received and renewed.

16. The control apparatus as claimed in claim 1, wherein the processor is configured to provide and display a report on normal operation or abnormal operation of the plurality of component devices for a predetermined time period based on the cycle data of the plurality of component devices.

17. The control apparatus as claimed in claim 1, wherein the processor is configured to receive the cycle data from at least one of the at least one outdoor device or one of the plurality of indoor devices connected to the at least one outdoor device.

18. The control apparatus as claimed in claim 1, wherein the processor is configured to be connected to at least one of the at least one outdoor device, one of the plurality of indoor devices, or a communication line connecting the at least one outdoor device and the plurality of indoor devices.

19. The control apparatus as claimed in claim 1, wherein the frame includes a monitoring window and an information display window.

20. The control apparatus as claimed in claim 1, wherein the connection state relates to a connection between a first one of the component devices and a second one of the component devices, and the cycle view frame displays information relating to the connection between the first one of the component devices and the second one of the component devices.

21. The control apparatus as claimed in claim 1, wherein the connection state is a connection between one of the at least one outdoor device and one of the at least one indoor device, and the cycle view frame displays information relating to the connection between one of the at least one outdoor device and one of the at least one indoor device.

22. The control apparatus as claimed in claim 1, wherein the connection state relates to a connection of two devices, and the cycle view frame displays information relating to the connection of the two devices.

23. The control apparatus as claimed in claim 1, wherein the connection state relates to whether a device is on or is off, and the cycle view frame displays information relating to whether the device is on or is off.

24. The control apparatus as claimed in claim 1, wherein the connection state relates to whether there is flow in a device or whether there is no flow in the device, and the cycle view frame displays information relating to whether there is flow in the device or whether there is no flow in the device.

25. The control apparatus as claimed in claim 1, wherein information of the operation state is displayed in a color, and when the operation state of the at least one of the plurality of component devices changes, the changes of a displayed object corresponding to the at least one of the plurality of component devices changes.

* * * * *